US005511579A

United States Patent [19]

Price

[11] Patent Number: 5,511,579

[45] Date of Patent: Apr. 30, 1996

[54] WATER CONSERVATION RECIRCULATION SYSTEM

[76] Inventor: William D. Price, 3445 Ashwood Ct., Oceanside, Calif. 92054

[21] Appl. No.: 359,053

[22] Filed: Dec. 19, 1994

Related U.S. Application Data

[63] Continuation-in-part of Ser. No. 198,361, Feb. 18, 1994, abandoned.

[51] Int. Cl.[6] ..... F16K 49/00

[52] U.S. Cl. ..... 137/337; 126/362; 417/12; 417/32

[58] Field of Search ..... 137/337; 126/362; 417/12, 32

[56] References Cited

U.S. PATENT DOCUMENTS

| | | | |
|---|---|---|---|
| 4,142,515 | 3/1979 | Skaats | 126/362 |
| 4,201,518 | 5/1980 | Stevenson | 417/32 |
| 4,606,325 | 8/1986 | Lujan, Jr. | 126/362 |
| 5,009,572 | 4/1991 | Imhoff et al. | 137/337 |
| 5,277,219 | 1/1994 | Lund | 137/337 |

*Primary Examiner*—A. Michael Chambers
*Attorney, Agent, or Firm*—Knobbe, Martens, Olson & Bear

[57] ABSTRACT

The present invention is a water conservation system that provides instant hot water at a user's sink. The system includes a backflow line positioned between the cold water line and a thermal switch. A check valve is placed in the backflow line to prevent hot water from entering the cold water supply. A thermal switch that contacts the flow of water is used to give a more accurate measurement of the hot water temperature. This system prevents large quantities of warm water from being pumped into the cold water supply.

7 Claims, 3 Drawing Sheets

WATER CONSERVATION RECIRCULATION SYSTEM

PRIOR RELATED APPLICATION

This application is a continuation-in-part of U.S. application Ser. No. 08/198,361, filed Feb. 18, 1994, now abandoned.

FIELD OF THE INVENTION

The present invention relates to water recirculation systems. More specifically, the invention relates to a water recirculation system wherein a backflow line is used to keep heated water from entering the cold water supply.

BACKGROUND OF THE INVENTION

Various recirculation systems have been developed in an effort to reduce the amount of water that is wasted by users of conventional plumbing systems while waiting for hot water to arrive at their tap. Most users just let the hot water faucet run until the cooled hot water has been removed from their pipes, and hot water arrives at the faucet. This method, however, wastes a lot of water down the drain. Some people have developed recirculation systems that constantly pump the cooled hot water into the cold water line. This water is returned to the water heater.

For example, U.S. Pat. No. 5,009,572 to Imhoff discloses a self-contained water conservation device which is installed under the sink in existing plumbing systems. The Imhoff device includes a temperature sensor that detects water temperature in the hot water line and begins pumping water into the cold water line if the water temperature in the hot water line falls below a certain preset level. However, this system pumps a significant amount of heated water into the cold water line. In the Imhoff system, a temperature sensor activates a pump that moves water from the hot water line to the cold water line. The temperature sensor activates the pump as long as the temperature in the hot water line is below a set threshold. Because the pump moves a tremendous quantity of warm water into the cold water supply, the cold water tends to become heated. This is not satisfactory for most users because their cold water ends up becoming lukewarm by the recirculation system.

Another system that has been used to provide instant hot water at a tap is disclosed in U.S. Pat. No. 5,277,219 to Lund. In this system a pump is positioned under a sink and between the hot and cold water delivery lines. Thus, the Lund system also recirculates water from the hot water delivery line through the cold water delivery line and into the hot water source. The Lund system relies on sensors to determine when the hot water faucet has been opened by a user. At this time, the pump is activated and cooled water is removed from the hot water line. In addition, Lund discusses positioning a switch at each faucet so that a user can push a button and start the pump. The pump then runs until it senses that the water in the hot water line has reached a certain temperature. However, this system also pumps a lot of warm water (or hot) into the cold water supply before the hot water temperature is sufficient to cause the sensor to turn off the pump. Thus, this system also has the same problems as the Imhoff patent discussed above.

One additional problem with recirculation systems that have been developed in the past is that their temperature sensors are not very accurate. Most systems use a temperature sensor that mounts to a water pipe and relies on the water heating the pipe to activate the sensor. This system leads to inaccurate measurements of the water temperature, thus adding to the amount of water pumped into the cold water supply. It would therefore be an advantage to provide a system that has a more sensitive mechanism for measuring the water temperature. There is a longstanding need in the technology for a means of effectively limiting the amount of warm water that enters the cold water line prior to and after the preselected water temperature is reached.

SUMMARY OF THE INVENTION

The present invention is a water recirculation system that includes a backflow line. The backflow line is used to recirculate water from a cold water line to a thermal switch. When the hot and cold faucets are in the off position the thermal switch senses the water temperature in the hot water line. If the temperature falls below a preset value, the switch actuates a pump that draws tepid water from the hot water line and pushes it into the cold water line. The backflow line allows recirculation of some of the tepid water through the backflow line and over the thermal switch. This recirculation process minimizes the amount of tepid water that enters the cold water line. If too much tepid water enters the cold water line, it will heat up the cold water so that a user desiring cold water will get warm water. This is unsatisfactory for most users.

When the temperature of the water coming from the hot water line reaches the preselected value, the thermal switch sends a signal to deactivate the pump. This prevents any more hot water from entering the cold water line. Thermal switches with varying temperature activation points can be used in the present invention to provide a choice of water temperatures for the user. The continuous recirculating capability of this system maintains the desired hot water temperature, while creating an effective water conservation system and not heating the water in the cold water line. The cost effectiveness of the pump and the limited activity of the pump necessary to maintain the preset value, promotes a cost efficient system.

DETAILED DESCRIPTION OF THE PREFERRED EMBODIMENTS

Figure 1:
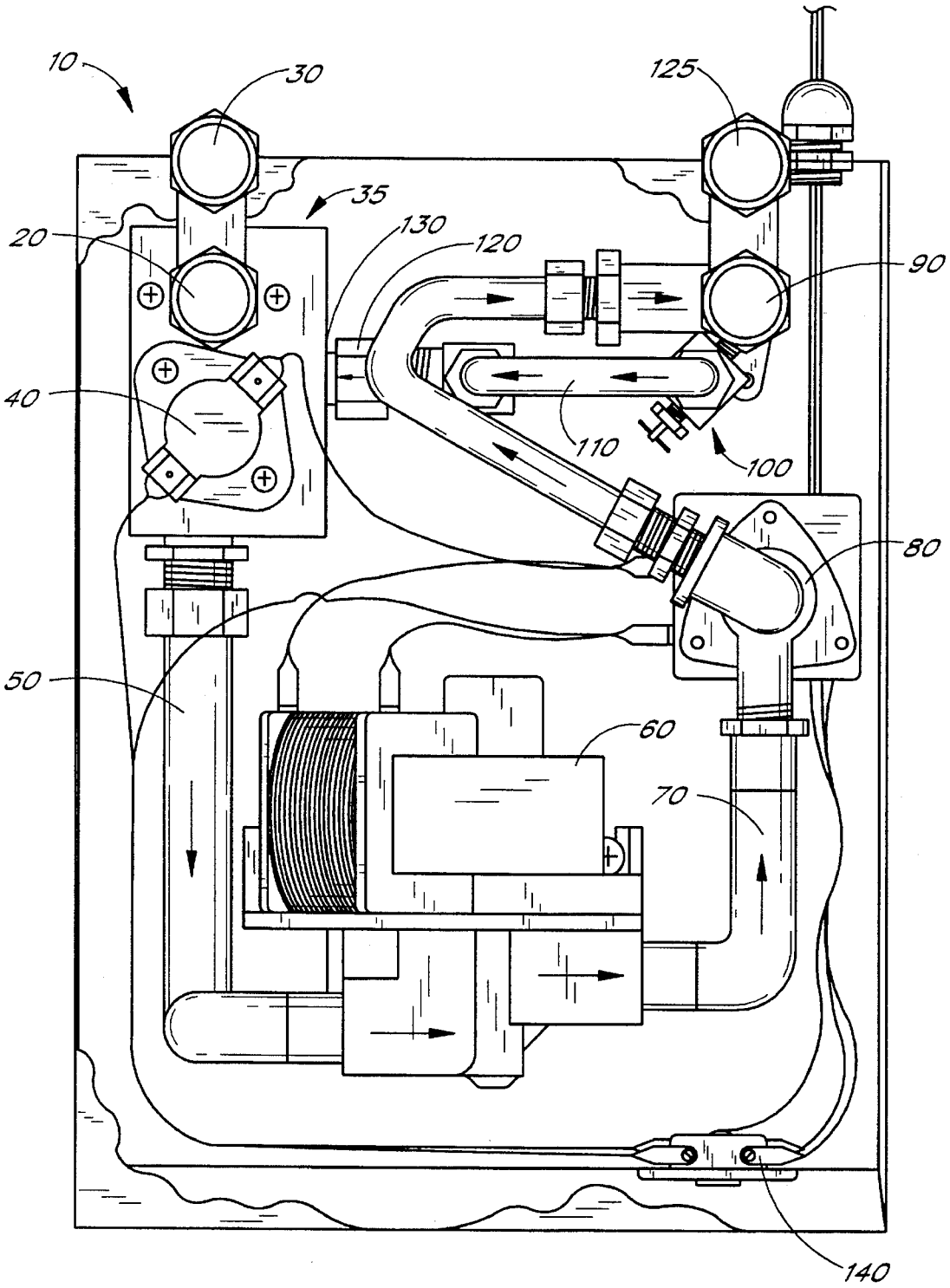
FIG. 1 is a plan view of the recirculation system of the present invention.

The present invention is a water recirculation system for providing instant hot water to an appliance. An appliance can be, for example, a faucet, a shower or a tub. The recirculation system of the present invention draws water from a hot water supply, and recirculates it through a cold water line, and back into the hot water supply. In a normal application the hot water supply is a water heater such as that found in most homes. A thermal switch in the recirculation system measures the water temperature coming from the hot water supply, and activates a solenoid and a pump when the water temperature drops below a preset temperature threshold.

Activation of the pump starts a process wherein tepid water from the hot water supply line is moved through the open solenoid and into the cold water supply line. Although some systems similar to this have been described in the prior art, the system of the present invention includes important features which provide for a more advantageous recirculation system. For example, the present invention includes several features including a more sensitive temperature switch and a backflow line to recirculate water within the system itself.

The temperature switch of the present invention is in direct contact with the water in the supply lines. Switches used in previous systems only sensed the temperature of the water pipe, and were not in contact with the water. The wet thermal switch of the present invention is much more sensitive for detecting temperature variations than previous switches which relied on temperature changes of the water pipe. The wet thermal switch of the present invention is mounted in a channeled manifold which specifically directs water onto the most sensitive portion of the sensor. For this reason, the recirculation system of the present invention can detect temperature changes much more quickly and specifically than prior systems.

In addition to the thermal switch, the present invention contains a backflow line positioned between the cold water supply and the thermal switch. This backflow line recirculates a portion of the water from the pump back to the temperature sensor. This design reduces heating of the cold water by directing some away from the cold water line and back through the recirculation system. The water that is placed back into the thermal switch is again recirculated through the recirculation system of the present invention. A needle valve is used to control the amount of water flowing through the backflow line and into the thermal switch. This system will be discussed in more detail below.

One advantage of the backflow line, is that when a user opens a hot water tap, some water from the cold side is pulled through the backflow line and over the thermal switch. Although only a small amount of cold water is initially pulled over the thermal switch, this cold water helps reduce the temperature at the sensor enough to activate the pump and immediately begin recirculating water. This is advantageous if the water from the hot water line has slowly begun to cool. Other prior art systems would not immediately switch on due to the gradual temperature decrease and stagnant water in the system. However, in the system of the present invention, the cold water that is drawn through the backflow line produces a rapid temperature drop at the thermal switch causing activation of the switch.

Referring specifically to FIG. 1, there is seen a hot water recirculation system 10 having a hot water supply line 20. The hot water supply line 20 normally runs from a water heater positioned at a distance from the recirculation system 10. The hot water supply line 20 runs from a hot water supply to a hot water faucet 30 and also to a thermal switch manifold 35. The thermal switch manifold 35 directs water from the hot water supply line 20 over a thermal switch 40. Specifics of the thermal switch manifold 35 and enclosed thermal switch 40 will be discussed in more detail below in reference to FIG. 2.

The thermal switch 40 includes the type of temperature sensor which measures the temperature of water flowing in a pipe. One preferred sensor is the THERMODISK® 60T11 made by THERM-O-DISK Incorporated (Mansfield, Ohio). This switch turns on at 97° F. and off at 107° F. Water flowing through the manifold 35 and over the thermal switch 40 moves into a pump inlet line 50 which flows to a water pump 60. The pump 60 can be almost any type of water pump known in the art, but a Hartell Model WR-7-1 pump manufactured by Milton Roy (Ivyland, Pa.) is most preferred. This pump moves water at about three gallons per minute. The water pump 60 pulls water from the pump inlet line 50 and pushes it out a pump outlet line 70. Water in the pump outlet line flows through a solenoid 80 and then into a valve 100. The solenoid 80 is electrically connected to the pump 60 and thermal switch 40 so that the solenoid 80 is only open while the pump 60 is activated. Once the thermal switch reaches its high temperature setting, the pump 60 and solenoid 80 are turned off. Closing the solenoid 80 prevents water from flowing back into the pump outlet line 70.

The water that is pumped from the pump outlet line 70 through the solenoid 80 meets the valve 100 and can flow into either a cold water supply line 90 or a backflow line 110. The valve 100 is preferably a needle valve which is well known in the art and can control the amount of water flowing to both the backflow line 110 and the cold water supply line 90. Water flowing into the cold water supply line 90 travels back to the hot water source and is reheated. Water flowing through the backflow line 110 traverses a check valve 120 and then moves through a thermal switch coupling 130 back into the thermal switch manifold 35. The check valve 120 prevents hot water from traveling from the manifold 35 to the cold water line 90. Without this check valve, hot water would flow into the cold water line 90 when a cold water faucet 125 is turned on. One of ordinary skill in the art knows that a check valve only allows water to flow in one direction through a water pipe. Thus, in the present invention, water can only flow in the backflow line from the cold water line 90 to the thermal switch manifold 35.

As shown in FIG. 1, the thermal switch 40 is electrically connected to the pump 60, solenoid 80 and a timer 140. The timer 140 controls whether the thermal switch 40 can activate the solenoid 80 and the pump 60. The timer of the present invention is preferably a First Alert™ Model LS220 manufactured by BNK Electronics (Aurora, Ill.), but any similar electronic timer would also function in the present invention. If the timer 140 is in an off position, then no power is transferred to the thermal switch 40, so that no matter what the temperature in the hot water line 20 becomes, the pump 60 and solenoid 80 will not activate. For example, as is well known in the art, the timer 140 will only allow the thermal switch 40 to activate the pump 60 and the solenoid 80 at specific times during the day. These times are preset into the timer 140 by the user.

Figure 2:
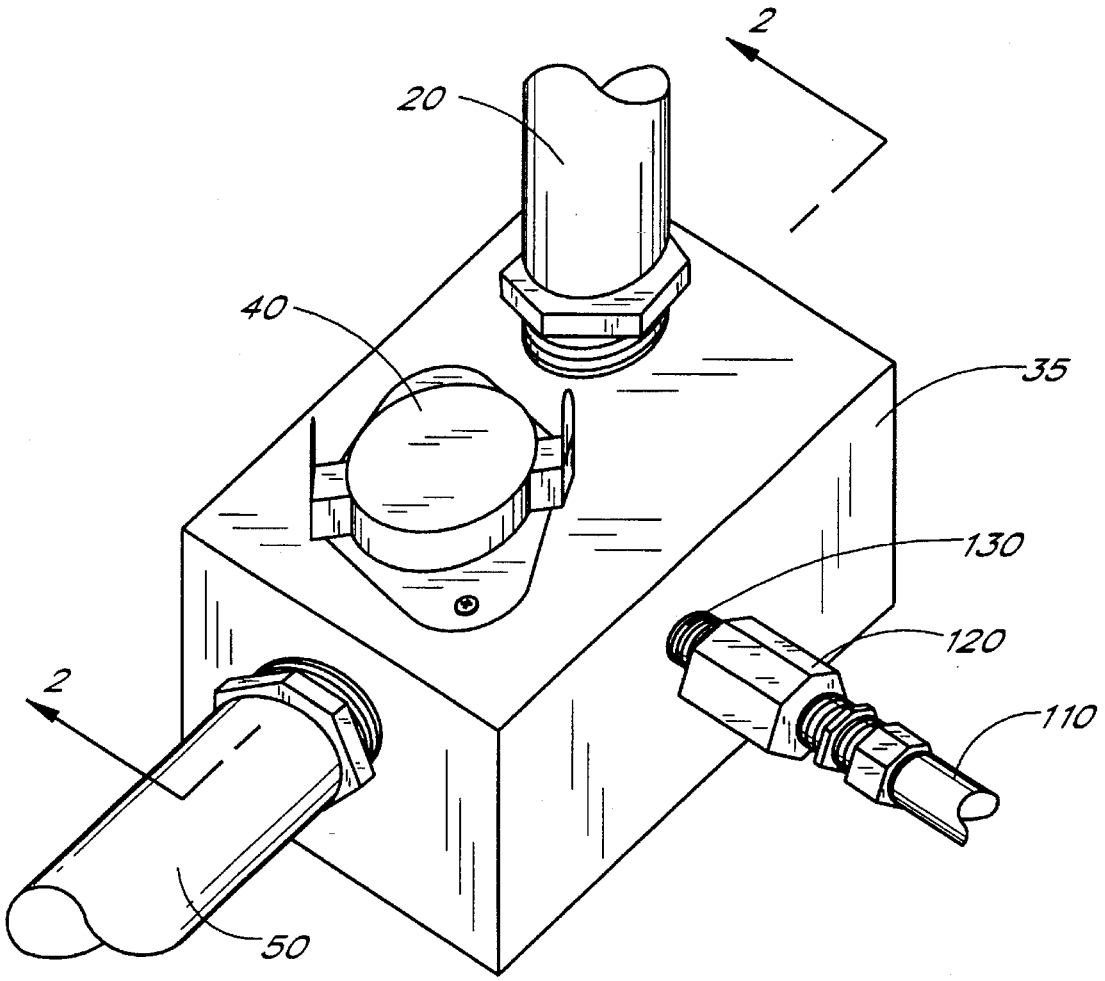
FIG. 2 is a perspective view of the temperature sensor housing of the present invention.

FIG. 2 provides more details of the thermal switch 40 mechanism. Upon reference to FIG. 2, one can see that the hot water line 20 connects to the top of the thermal switch manifold 35. The manifold 35 also has ports for the backflow line 110 and pump inlet line 50. Water from the hot water supply line 20 converges in the manifold 35 with water from the backflow line 110 and is forced across the thermal switch 40. After passing over the thermal switch 40, the water exits the manifold 35 through the pump inlet line 50.

Figure 3:
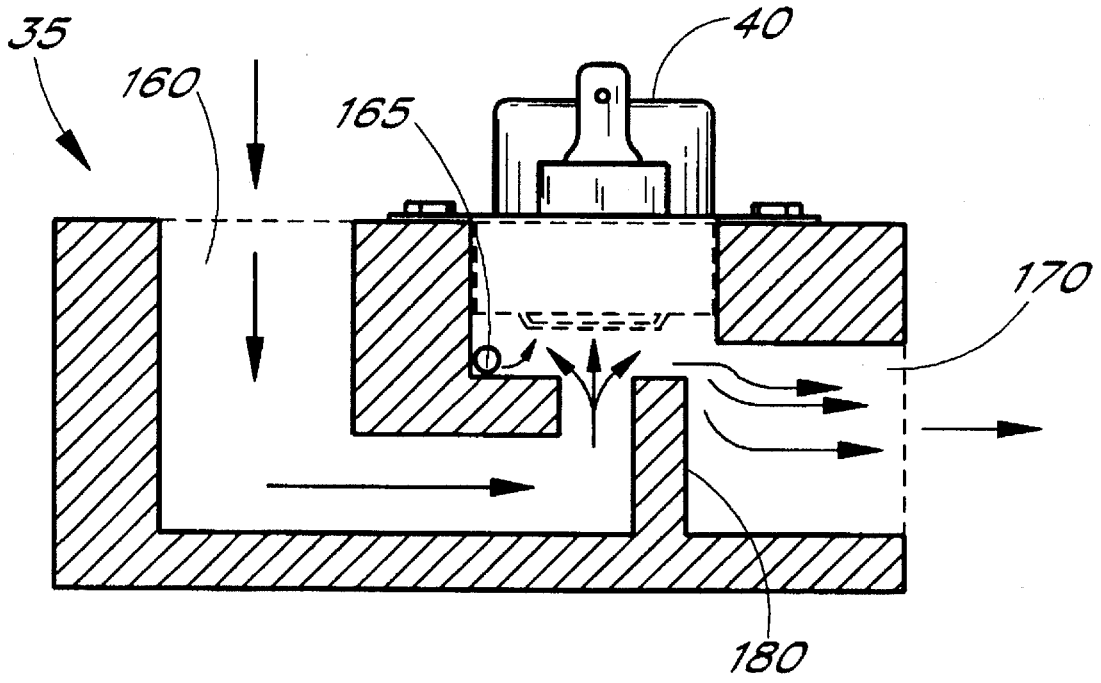
FIG. 3 is a cross-sectional view of the temperature sensor manifold of the present invention taken along line 2—2 of FIG. 2.

Referring now to FIG. 3, it can be seen that water from the hot water line 20 is forced into a thermal switch manifold inlet 160 and then out an opening 170 to the pump inlet line 50. Between the thermal switch housing inlet 160 and the opening 170 is an agitator wall 180. Water flowing from the inlet 160 to the opening 170 contacts the agitator wall 180 and is forced upwards towards the thermal switch 40. The thermal switch 40 is located on top and slightly off center of the thermal switch manifold inlet 160. The agitator wall 180 is perpendicular to the direction of water flow from the inlet 160. Thus, when water strikes the agitator wall 180 it is forced upwards toward the thermal switch 40. The agitator wall 180 forces water to strike the thermal switch 40 in its center. This is the most sensitive portion of the thermal switch 40. Most systems have a thermal switch that is attached to the wall of the pipe, and cannot provide the accurate temperature measurement that is achieved by the present invention.

In addition, even if a temperature switch was located inside the water pipe, the present invention agitator wall 180 forces water to strike the switch 40 in its most sensitive area. This makes the temperature switch of the present invention advantageous over temperature sensor configurations of prior systems.

FIG. 3 also shows the inlet port 165 for the backflow line 110. Water from the backflow line 110 moves through the check valve 120 and coupling 130 and enters the thermal switch housing 35 at the inlet port 165. The inlet port 165 is located just below the thermal switch 40. Water from the backflow line 110 enters the manifold 35 at the inlet port 165 and mixes with water that has been forced upwards by the agitator wall 180. After the water from the inlet port 165 mixes with water from the thermal switch housing inlet 160, it passes out through the opening 170 and into the pump inlet line 50.

FUNCTIONAL DESCRIPTION OF RECIRCULATION SYSTEM

The present invention is a device for efficiently maintaining a hot water supply at an appliance. Normally, the system is installed in a home, underneath a sink. As shown upon reference to FIG. 1, hot water enters the recirculation system 10 through the supply line 20. Hot water from the supply line 20 moves into the thermal switch manifold 35 and across the thermal switch 40. FIG. 3 details the path of the water through the thermal switch manifold 35. After entering the manifold inlet 160, water strikes the agitator wall 180 and is forced upwards and in contact with the thermal switch 40. The water strikes the thermal switch 40 in the center of the switch, its most sensitive part.

The thermal switch 40 is set to activate when it senses that the water has dropped below a preset temperature. In one embodiment of the present invention, a timer determines hours of the day that the recirculation system is active. For example, a user can set the timer to turn on the system for one hour in the morning and five hours at night. In this manner, the recirculation system will be active when the user gets up in the morning and is home at night. The user will have instant hot water in the morning and at night, but the system will not waste electricity by running when the user is not home during the day.

The thermal switch of the present invention can be set to activate upon sensing a water temperature of, for instance, between 95° and 98° F. One of ordinary skill in the art will recognize that other temperature ranges could also be chosen by selecting various thermal switches. In addition, electronic control circuitry could be added to the present invention to allow a user to control the temperature upper/lower ranges by means known in the art. If the water drops below the set temperature of the thermal switch, the water pump 60 activates and the solenoid 80 opens.

Water is then moved by the pump 60 from the hot water supply line 20, through the thermal switch 40, past the pump inlet line 50 and into the pump outlet line 70. Because the solenoid 80 opens at the same time that the water pump 60 activates, water flows past the solenoid 80 and towards the cold water supply line 90. On the way to the cold water supply line 90, the water passes through the needle valve 100. Thus, hot water is pumped from the hot water line 20 into the cold water line 90. The needle valve 100 allows an adjustable quantity of the pumped water to be redirected through the backflow line 110 into the thermal switch housing 35. A check valve 120 keeps water from flowing from the thermal switch housing 35 back into the cold water supply 90.

This design allows an adjustable quantity of the pumped water to flow back across the thermal switch 40 and recirculate into the pump inlet line 50. This design advantageously prevents a large quantity of warm water from being pumped into the cold water supply 90. As can be imagined, users do not like their cold water supply to be heated. Thus, the backflow line 110 in this system keeps the cold water supply of the house from being heated by hot water from the hot water supply.

Another advantage of this recirculation system is that the thermal switch 40 is immediately contacted with cooled water from the backflow line 110 once the hot water faucet 30 is opened. For example, when a user opens the hot water faucet 30, hot water is initially drawn towards the faucet. Simultaneously, some water from the cold supply 90 will be pulled through the needle valve 100 into the backflow line 110 and over the thermal switch 40. This cooled water will immediately lower the temperature around the thermal switch 40 and cause it to be activated if it reaches its lower set point.

A disadvantage of other systems in the art, is that the gradual decrease in water temperature across the thermal switch does not always properly activate the pump once a faucet is turned on. In this system, cool water is immediately splashed across the thermal switch 40 upon opening the hot water faucet 30. By activating the pump 60 as soon as a hot water faucet is opened, water from the hot water supply 20 will be pumped towards the cold water supply line 90. This will increase the volume of water being pulled from the hot water supply, thus delivering hot water to the user in a shorter period of time.

One of skill in the art can also appreciate that having a timer 140 controlling the thermal switch 40, solenoid 80, and water pump 60 also makes the system more cost effective. The timer 140 only allows activation of the water pump 60 and solenoid 80 at specific times of the day. For example, a user could set the hot water recirculation system 10 to be activated during the hours that he will be awake in the morning and at home in the night. Thus, the user will have instant hot water at his faucets during the hours that he is at home, but will save energy because the pump will not be running while the user is away from home during the day.

While certain preferred embodiments of the invention have been discussed herein, these are only examples of some types of recirculation systems. The present invention should not be limited to these specific examples, but should only be limited by the appended claims.

I claim:

1. A water recirculation system comprising:

a hot water source and a cold water source;

a hot water delivery line connected between said hot water source and at least one plumbing fixture;

a cold water delivery line connected between said cold water source and said plumbing fixture;

said hot water delivery line and said cold water delivery line being in communication with each other through a recirculation line;

said recirculation line including a pump and a temperature control switch, wherein said pump is activated by said temperature control switch when the temperature of the water in said recirculation line falls below a preselected value;

a backflow line connecting said cold water delivery line to said recirculation line so a portion of the water from the cold water line flows past said temperature control switch, wherein a portion of the water moved by said pump towards the cold water delivery line is also directed into said backflow line; and a directional valve positioned in said backflow line so that water can only flow from the cold water delivery line to the temperature control switch.

2. The water recirculation system of claim 1 wherein said plumbing fixture is a faucet.

3. The water recirculation system of claim 1 wherein said backflow line is in communication with said cold water line through a needle valve.

4. The water recirculation system of claim 1 wherein said recirculation line further comprises a solenoid valve that opens only when said pump is activated.

5. The water recirculation system of claim 1 wherein said temperature control switch directly contacts the water in the recirculation line.

6. The water recirculation system of claim 1 wherein the temperature control switch is in a housing, and said housing has an agitator wall that directs water to the central part of the temperature control switch.

7. The water recirculation system of claim 6 wherein said agitator wall is positioned perpendicular to the path of the water.

* * * * *